United States Patent [19]

Reba

[11] 4,377,985

[45] Mar. 29, 1983

[54] SYSTEM FOR PRODUCING A LIQUID SPRAY CURTAIN

[75] Inventor: Imants Reba, Vancouver, Wash.

[73] Assignee: Crown Zellerbach Corporation, San Francisco, Calif.

[21] Appl. No.: 290,466

[22] Filed: Aug. 6, 1981

Related U.S. Application Data

[63] Continuation of Ser. No. 151,023, May 19, 1980, abandoned.

[51] Int. Cl.[3] ..... B05D 7/08; B05B 7/12; B05B 1/16

[52] U.S. Cl. ..... 118/315; 118/300; 118/325; 239/420; 239/433; 427/284; 427/421; 427/424

[58] Field of Search ..... 239/290, 292, 295, 300, 239/420, 433; 118/300, 325, 315; 427/421, 424, 284

[56] References Cited

U.S. PATENT DOCUMENTS

| | | | |
|---|---|---|---|
| 958,999 | 5/1910 | Fordice | 239/420 |
| 1,020,024 | 3/1912 | Casebolt | 239/420 |
| 1,752,923 | 4/1930 | Mueller | 239/292 |
| 1,888,791 | 11/1932 | Cole | 239/8 |
| 3,750,955 | 8/1973 | Nakai et al. | 239/420 |
| 4,060,874 | 12/1977 | Furutsutsumi | 239/300 X |
| 4,171,096 | 10/1979 | Welsh et al. | 239/420 |

*Primary Examiner*—Shrive P. Beck

*Attorney, Agent, or Firm*—Jerome S. Marger

[57] ABSTRACT

A method and a system are provided for producing a continuous liquid spray curtain which, when sprayed onto a moving surface, covers essentially the entirety of that surface without substantial streaking thereof. The subject spray curtain is produced by discharging a continuous air curtain at a relatively high velocity of at least 600 feet per second. A plurality of liquid streams are at the same time discharged from a liquid discharge means at a relatively low velocity of not more than about 20 feet per second. The air curtain contacts the liquid streams at a minimum contact angle of between about −10° and about +30°, measured from the center line of the liquid discharge means. The contacting air curtain atomizes the liquid streams and forms the subject high velocity, uniform, liquid spray curtain.

25 Claims, 3 Drawing Figures

SYSTEM FOR PRODUCING A LIQUID SPRAY CURTAIN

This is a continuation of application Ser. No. 151,023, filed May 19, 1980 now abandoned.

BACKGROUND OF THE INVENTION

This invention relates to a method for producing a continuous liquid spray curtain capable of uniformly covering essentially the entirety of a moving surface, without substantial streaking thereof.

Prior art systems have been provided for spraying a liquid onto a moving surface. For example, a plurality of hydraulic nozzles can be employed for liquid spraying, the number of nozzles employed being determined by the width of the surface to be sprayed. However, hydraulic nozzles emit a spray in a circular or elliptical pattern. This causes *nonuniform* coverage of the moving surface because the respective sprays emanating from adjacent hydraulic nozzles are difficult to interface one with the other over the entire width of the moving surface. Thus, streaking results due to these respective oversprayed or undersprayed areas. Streaking is a particular problem in certain applications, such as, for example, spraying a creping adhesive onto a cellulosic web, or onto a thermal drying cylinder, since nonuniform adhesion of the web to the thermal drying cylinder results in a nonuniformly creped sheet having substandard physical properties. Furthermore, the dried, creped web will not wind evenly into a parent roll on the papermaking reel if creping is nonuniform. This will lead to substantial problems when the parent roll is converted to product.

Another serious problem associated with certain nozzles, such as hydraulic nozzles, is plugging of the nozzle tips. Plugging terminates liquid flow causing widespread streaking to occur due to the aforementioned nonuniform spray application. Hydraulic nozzles operate at a relatively high solution flow rate. Therefore, if an adhesive is the liquid material sprayed, a total solids level must be selected at a given liquid flow rate which will not provide too large an amount of adhesive to be sprayed onto the moving surface. This will cause a boardy sheet to be formed. Thus, a lower, overall total solids liquid must be employed at a higher total solution flow rate in order to supply the prescribed amount of solids add-on to the surface to be sprayed. This results in the use of much higher water consumption level, as well as a substantial increase in the thermal energy required for drying purposes.

The exit velocity of the liquid in a hydraulic nozzle system determines the requisite degree of atomization of the liquid. In the case of a hydraulic nozzle, the liquid exit velocity is relatively high. The exit velocity is primarily a function of the liquid supply pressure. A high liquid supply pressure presents severe operating hazards to equipment and personnel.

Another approach in spraying a liquid onto a moving surface is the use of sonic nozzles. These nozzles typically spray particles of a smaller, more uniform size particle distribution than those produced by hydraulic spraying. A discussion of this type of spraying appears in pending application U.S. Ser. No. 99,041, which is assigned to the assignee herein. One of the major problems which can result from the use of a plurality of sonic nozzles for spraying onto a moving surface is that the finer the spray which is produced, the lower the momentum of the spray particles. This, in turn, reduces the effect of penetration by the spray particles of the boundary air layer between the nozzle and the moving surface, resulting in a significantly higher level of spray migration and a lower solids addition to the moving surface. Furthermore, the same coverage problems associated with hydraulic nozzles are present herein because of the circular spray patterns produced by each adjacent sonic nozzle. Finally, the sonic nozzles exhibit plugging problems similar to those described above for hydraulic nozzles.

Other prior art systems have attempted to provide a plurality of sprays from a common source. U.S. Pat. No. 1,888,791 to Cole, for example, describes an apparatus which discharges liquids through jets 1–3. The discharge liquid intersects air streams 4–6 outside the discharge orifices at a substantially maximum angle with respect to the central axis of the liquid jet so that the air streams impede the progress of the liquid jet flow and creates a back-pressure. Any change in the air velocity or impingement angle will change the back-pressure. For example, any increase in the back-pressure, such as caused by an increase in the air velocity, will result in a decrease in both the liquid velocity and in the amount of liquid sprayed. Thus, since the velocity and amount of liquid sprayed, respectively, will be changed by changes in the back-pressure, spray uniformity in both the lateral (coverage) and longitudinal (uniform rate) directions will be difficult to maintain. Therefore, higher relative liquid pressures and velocities then desired must be maintained with respect to the Cole apparatus in order for the system to function since small variations in either the air or liquid discharge velocity will result in substantial changes in the lateral and longitudinal spray pattern. This results in the aforementioned streaking, uniformity, and coverage problems. Finally, the air stream in Cole emanates from individual sets of jets 4–6. Therefore, the air stream is discontinuous over the entire longitudinal extent of the apparatus. A discontinuous air stream will create a discontinuous spray flow pattern, resulting in streaking and nonuniform coverage of the surface being sprayed.

With respect to certain moving surfaces, such as cellulosic webs, and the like, a nonuniform moisture profile typically exists in which the edges of the webs are much drier than the central portion. Coverage of these webs with moisturizing liquids to a desired moisture level can be accomplished by the addition of water to increase the moisture level at the edges of the web. Some prior art systems, such as sonic nozzles, attempt to correct this problem by changing the flow rates of a plurality of individual sonic nozzles in a given system so as to alter the moisture profile of the web. Instead, the system provides a random, nonuniform, uncoordinated spray pattern.

SUMMARY OF THE INVENTION

The above described problems associated with prior art systems have been overcome by the method of the present invention. The subject method provides an essentially continuous liquid spray curtain capable of uniformly covering essentially the entirety of a moving web without substantial streaking thereof. The liquid spray curtain is produced by discharging a plurality of streams of liquid to be sprayed from a discharge means at a relatively low discharge velocity. At the same time, a continuous, high velocity air curtain is also discharged which is directed toward the liquid streams and contacts same at a minimum contact angle $\beta$, measured from the center line of said liquid discharge means, of from about $-10°$, and preferably from about $-5°$, up to about $+30°$, and more preferably up to about $+10°$. When the high velocity air curtain contacts the low velocity liquid at the above prescribed minimum contact angle, the liquid velocity is substantially increased and the liquid is atomized, thereby forming a high velocity, continuous, uniform liquid spray curtain. The high velocity liquid spray curtain exhibits a relatively high boundary layer penetration level in a controled, extensive particle range. Accordingly, essentially the entire moving surface is covered with the liquid spray in a uniform manner, and without substantial interfacing or streaking problems, as previously described.

Spraying of a relatively high total solids liquid can be accomplished when the process of this invention is employed without the problems associated with the prior art. Thus, the total liquid flow rate can be decreased at a given total solids level. This will, in turn, decrease the total water consumption and the thermal drying costs associated with the prior art solution levels.

The total amount of liquid sprayed on the moving surface in the method of the present invention is preferably only up to about 50%, and more preferably up to about 25%, as compared to hydraulic nozzles at the same total solids level.

The use of a higher total solids liquid results, to a great degree, from the subject liquid discharge means having a substantially higher total cross-sectional flow area per foot ($A_x$) than that of a comparable hydraulic discharge means ($A_h$). The ratio of $A_x$:$A_h$ at a given total solids flow rate is generally at least about 30, and preferably at least about 60, and more preferably at least about 120.

The liquid discharge velocity for the method of the present invention is relatively low and preferably is not greater than about 20 feet per second, and more preferably not greater than about 5 feet per second, and most preferably not more than about 2 feet per second. This is in total contradistinction to the aforementioned prior art methods which employ substantially high liquid flow velocities to overcome an impeding air flow, as in the case of the Cole patent, and, in the case of the hydraulic and sonic nozzles, for overcoming the air boundary layer between the system and the surface.

It is not only important for the liquid flow rate to be low, it is also important for the discharge velocity of the air curtain to be substantially higher than that of the discharge velocity of the liquid. The discharge velocity of the air curtain is preferably at least about 600 feet per second, and more preferably at least about 1,000 feet per second, and most preferably at least about 1,200 feet per second. Furthermore, the respective liquid and air velocities are maintained so that substantial atomization of the liquid will result.

Moving surfaces of differing widths can be effectively sprayed by employing a method of this invention. In the aforementioned prior art systems, accurate, controled, uniform coverage, especially at the surface edges, is difficult to maintain since the spray pattern produced by these prior systems is discontinuous. The subject method, on the other hand, provides for readily adjusting the width of the continuous spray curtain, depending on the width of the moving surface to be sprayed. This is done by closing off or opening, in a controlled manner, only the outermost liquid sprays so that the width of the curtain will correspond to the width of the moving surface. Such an adjustment can be made to quite a narrow tolerance range since the liquid discharge means are in close proximity one to the other.

In order to substantially eliminate prior art problems associated with variabilities in the respective flow rates as, for example, caused by disparities in the liquid or air supply pressure, certain modifications have been provided. Specifically, each liquid header system includes labyrinth means which internally meters and longitudinally distributes the liquid flow, causing a constant span-wise pressure or static head to be maintained in a liquid reservoir which extends across the entire longitudinal distance of the discharge means. The presence of this liquid reservoir insures that a constant, static liquid head will be maintained at the discharge means and that the liquid spray curtain will therefore operate at steady-state conditions.

Certain moving surfaces, such as cellulosic webs on the paper machine, have a substantially nonuniform moisture profile, i.e., the moisture level is substantially lower at the edges than at the center. The previously described conventional systems are not capable of effectively controling the spray from both a quality and quantity standpoint so that the moisture profile of the web cannot be modified to the extent that it becomes uniform across the entire web surface. By varying the liquid flow supply at various points in the respective individual headers, an inverted moisture profile is provided in the method of the present invention in which more moisture is sprayed at the edges of the moving surface than in the interior portion thereof while, at the same time, maintaining the same total amount of liquid spray addition. Moisture profile measurement means can be provided for continuously monitoring the moisture profile of the web at a point upstream from the subject spray system. The flow rate can then be adjusted at various points in the individual liquid supply headers to compensate for these disparities.

DETAILED DESCRIPTION OF THE DRAWINGS

FIG. 1 is a sectional view of the subject liquid spray curtain system 10 supported by beam 70 and including liquid and air supply means 20 and 40, respectively.

DETAILED DESCRIPTION OF THE INVENTION

Figure 1:
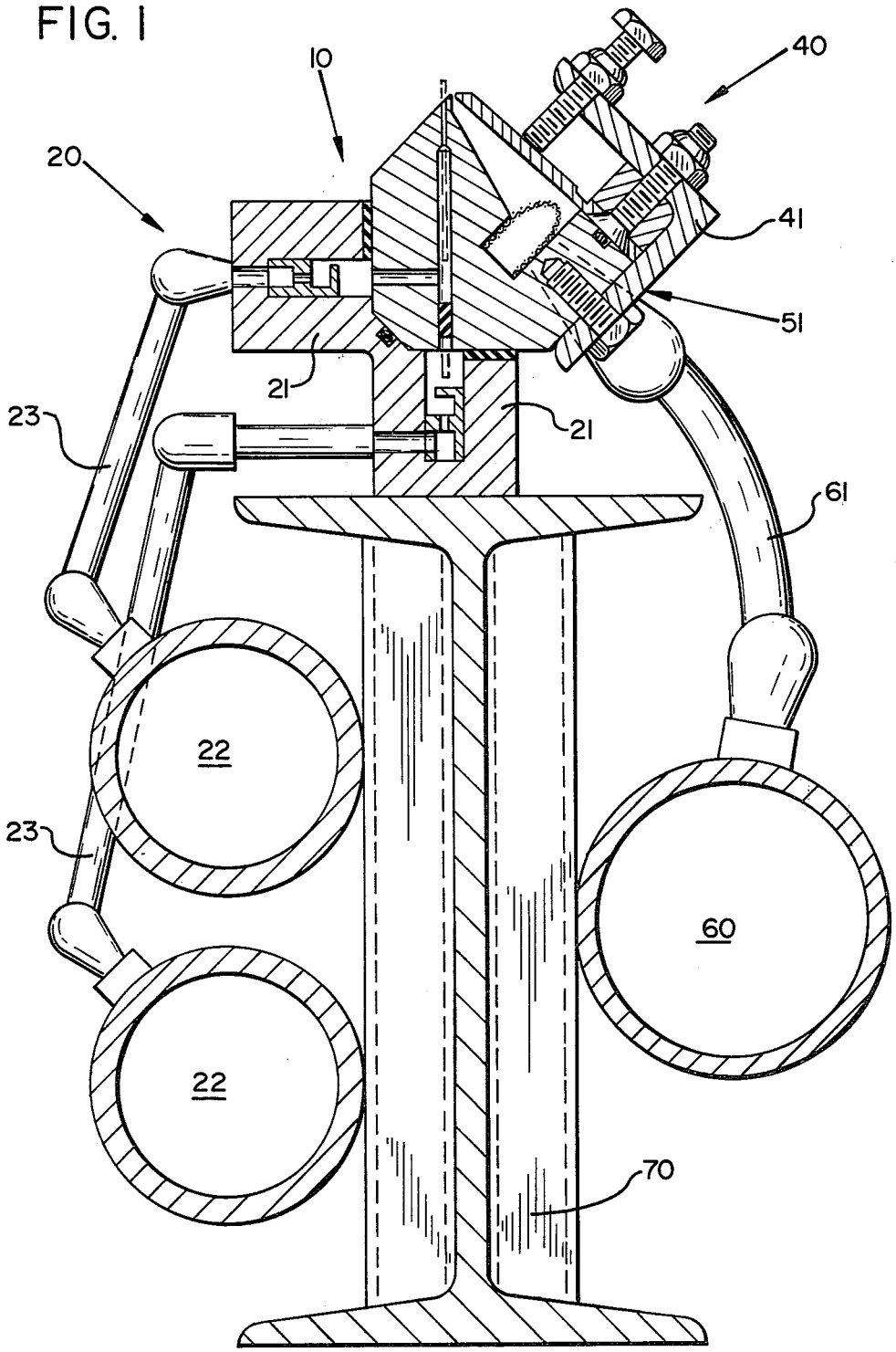

Referring now to FIG. 1, the present invention comprises a system 10 for producing a liquid spray curtain, as generally depicted therein. More specifically, the system 10, which, in FIG. 1, is attached to and supported by beam 70, includes a liquid supply means 20 and an air supply means 40, respectively. The liquid supply means, in general, comprises at least one liquid supply header, in this case denoted "21" and "21'", having a plurality of liquid supply lines 23 attached, at one end, thereto. The liquid supply lines 23 are, at the other end, connected to a liquid supply conduit 22 which transports the liquid from a liquid storage means (not shown) employing a pump or other like means to provide the driving force for transporting the liquid.

Air supply means 40 comprises an air supply header 41 to which a plurality of air supply lines 61 are connected. At the other end, the air supply lines 61 are connected to air supply conduit 60 which transports air, under pressure, employing a compressor or like means to provide the driving force.

Figure 2:
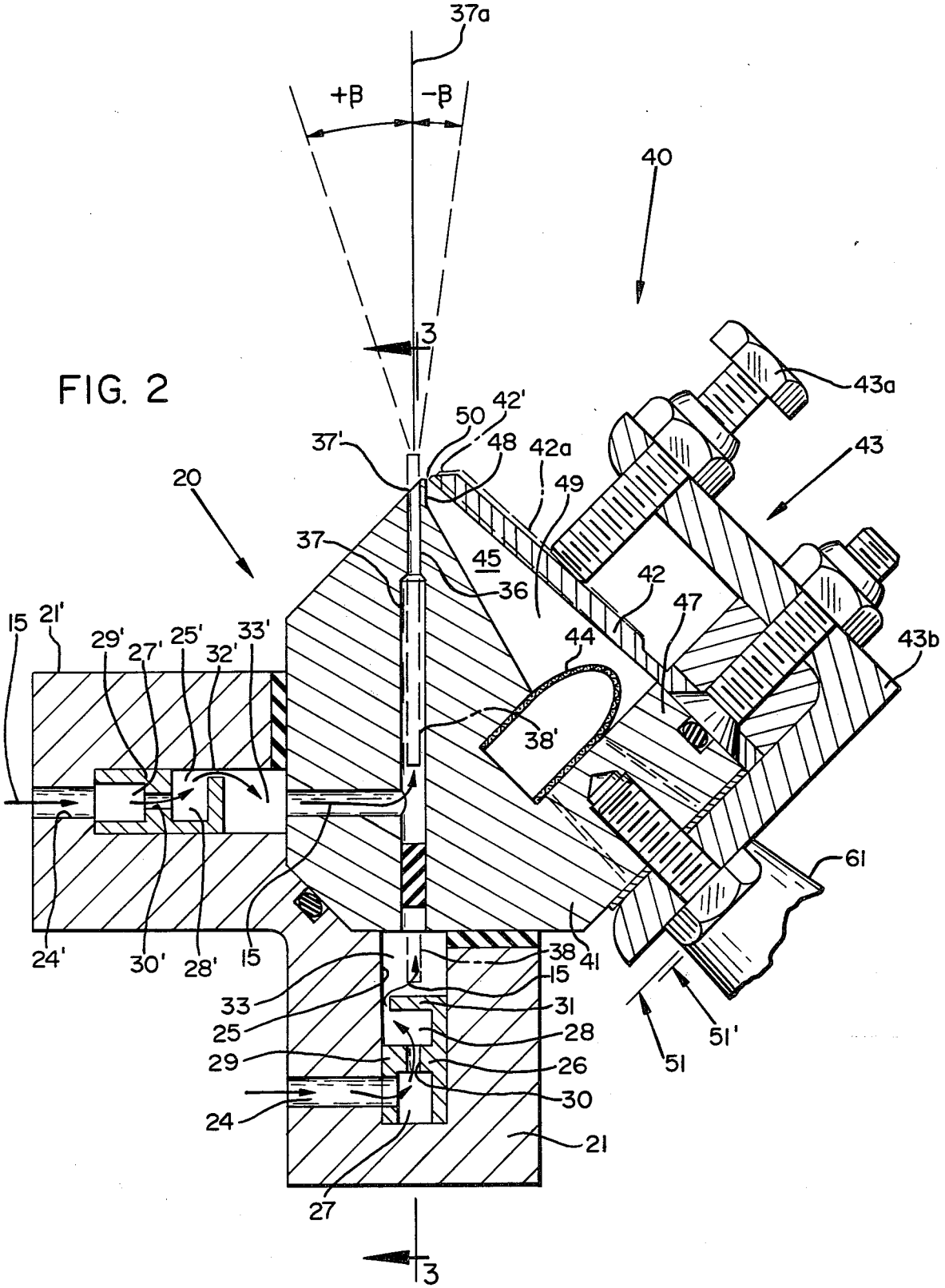
FIG. 2 is a detailed, enlarged sectional view of the system 10 of FIG. 1 per se.
Figure 3:
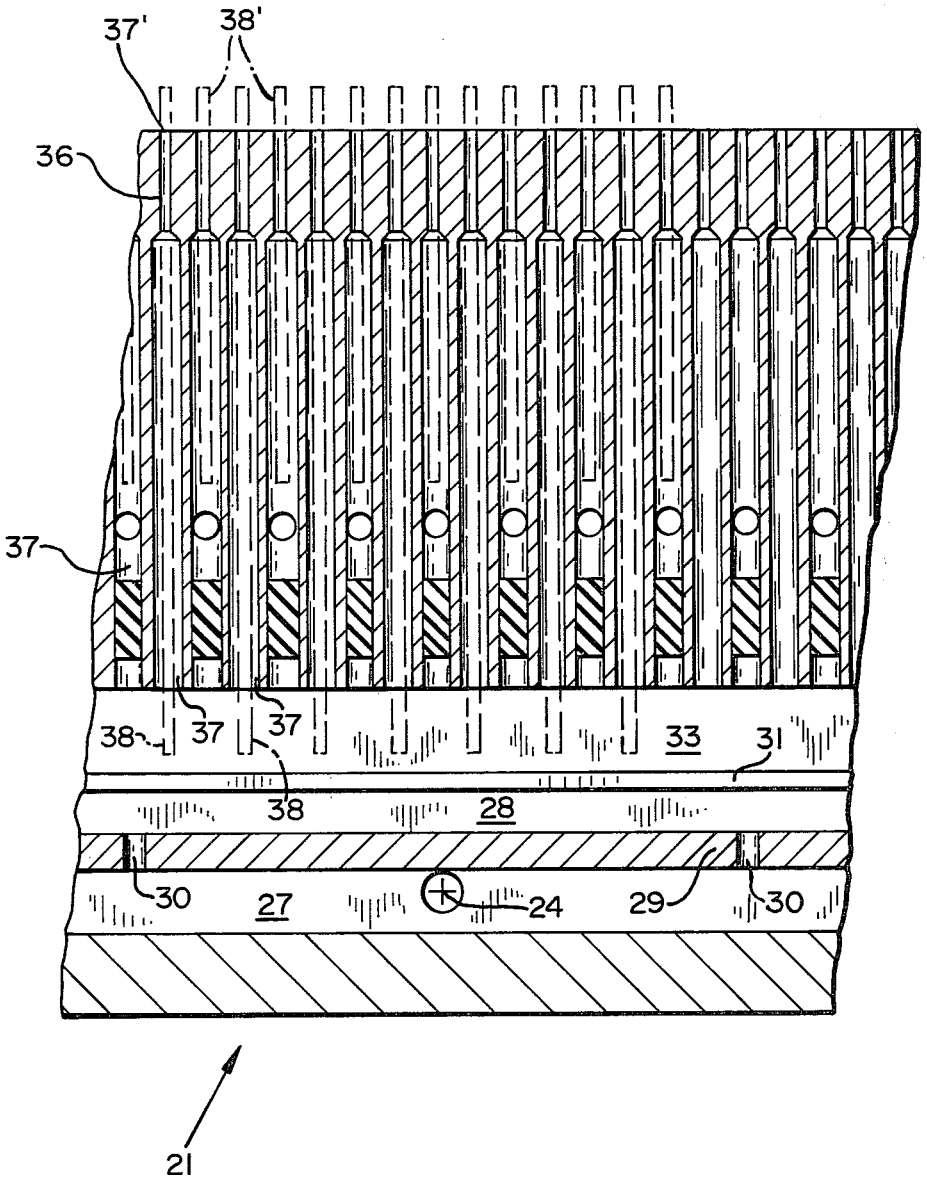
FIG. 3 is a detailed, sectional view taken along line 3—3 of FIG. 2.

As set forth in FIGS. 2 and 3, liquid supply headers 21 and 21', which discharge a plurality of liquid streams from discharge means 37 at a relatively low velocity, include inlet supply means 24 and 24' which supply the appropriate liquid to supply chambers 25 and 25'. Preferably, liquid supply headers 21 and 21' are disposed at right angles one with respect to the other. Liquid supply chambers 25 and 25' have located therewithin labyrinth means 26 and 26' internally metering and longitudinally distributing the liquid flow. Specifically, labyrinth means 26 and 26' comprise, preferably, first compartments 27 and 27', in which the liquid is initially collected, the liquid being restrained from flowing freely by first barrier means 29 and 29'. Liquid supply orifices 30 and 30' are also provided which permit a reduced flow of liquid to the second compartments 28 and 28', where the liquid is again collected. The flow is restricted in this case by second barrier means 31 and 31'. The liquid then moves to a liquid reservoir means 33 and 33' from labyrinth means 26 and 26', respectively, through liquid supply slots 32 and 32' in the respective second barrier means 31 and 31'. Both the liquid reservoir means and the liquid supply slots, respectively, extend along the entire longitudinal distance of the liquid supply headers 21 and 21'. When the reservoir is filled with liquid, it remains in liquid communication with discharge means 37, having an exit orifice 37', which is adapted for liquid communication with said reservoir, to provide a continuous, uniform flow rate of liquid. The liquid moves to discharge means 37 from reservoirs 33 and 33', through exit passageways 35 and 35'. Liquid flow tubes 38 and 38' (in phantom), having exit orifices 39 and 39', are preferably disposed within discharge means 37 for further controling the discharge of the liquid. The discharge means 37 preferably has a narrowed end section 36 which provides, if necessary, means for readily maintaining liquid flow tubes 38 and 38' in proper position and alignment. As depicted in FIGS. 2 and 3, liquid flow tubes 38 and 38' are preferably in individual and alternative communication with the liquid in a pair of liquid supply headers 21 and 21', respectively. This permits a more controled liquid flow and allows the system to continue in operation even if one of the headers requires maintenance.

As depicted in FIG. 2, air supply means 40 comprises an air supply header 41, which discharges a continuous, high velocity air curtain, from exit air slit 50, for contact with said liquid streams, as hereinafter provided. The air supply header 41 includes means denoted "43" and "51" for adjusting the respective magnitudes of the exit air slit 50 and the air contact angle $\beta$, as hereinafter described. Exit air slit 50 is preferably continuous along the entire longitudinal extent of the system 10.

The air from air supply line 61 enters central air supply chamber 49 through an inlet means 44. Air supply chamber 49 is formed within the confines of said air supply header 41 and converges at its outermost end to form a continuous exit air slit 50. The header 41 comprises a first sidewall member 46, a pair of endwall members 45 (only one shown), and a floor member 47, respectively, joined one to the other, and a second sidewall member 42 adapted for movement to a plurality of positions with respect to said first sidewall member 46. By properly positioning movable second sidewall member 42 with respect to first sidewall member, such as position "**42*a*" (in phantom), exit slit 50** can be adjusted to said plurality of set magnitudes.

The supply pressure of the air in conduit 60 substantially controls the velocity of the air being emitted from air slit 50. Preferably, the air supply pressure in conduit 60 is maintained at from about 5 psig, up to about 40 psig, and more preferably from about 10 psig, up to about 25 psig.

The quantity of air emitted from exit air slit 50 is controled by the magnitude of the opening of slit 50. The quantity of air emitted from slit 50, to a great extent, controls the penetration of the liquid spray curtain with respect to the boundary air layer. The magnitude of slit 50 is chosen depending on the viscosity and quantity of the spray liquid, the distance from the spray exit to the moving surface, and the velocity of the moving surface. Preferably, the magnitude of exit air slit 50 is maintained at a slit opening of from about 0.002 inch, up to about 0.010 inch, and more preferably from about 0.003 inch, up to about 0.006 inch.

The relative position of second sidewall member 42 with respect to first sidewall member 46, employing air slit adjustment means 43, such as nut-and-bolt arrangement **43*a'* passing through bracing member 43*b*. Bracing member 43*b* is connected to air supply header 41 by attachment means 43*c***, which, in this case, is a nut-and-bolt assembly.

An air flow guide means 48 is located at the outermost end of first sidewall member 46. Guide means 48 is disposed with respect to the center line **37*a* of liquid discharge means 37 such that when said second sidewall member 42 is positioned with respect to air guide means 48, a high velocity, continuous air curtain is discharged from said exit slit which will contact said liquid streams at the previously described minimum contact angle. Preferably, air flow guide means 48 is disposed parallel to the center line of said liquid discharge means 37. The movement of sidewall member 42 to various positions with respect to guide means 48 within the limits of angle $\beta$, as previously described herein, is preferably provided employing adjustment means 51, which is preferably a screw arrangement. As shown in FIG. 2, adjustment means 51 is connected to bracing member 43*b* and air supply header 41, respectively. Thus, by moving adjustment means 51 to position "51'" (in phantom), sidewall 42 can also be moved to position "42'" (in phantom) with respect to guide means 48**, thereby adjusting the magnitude of angle $\beta$.

In order to reduce the variations in the inlet air flow, a means "44" for creating a pressure drop and thereby reducing the pressure peaks in the inlet air flow can be provided. Means 44 is preferably in the form of screen means which modifies the inlet air so that it assumes a uniform span-wise pressure distribution and a uniform exit velocity.

In use, the liquid spray curtain 16 which is emitted is capable of uniformly covering essentially the entirety of the moving surface. The liquid spray curtain 16 is formed by discharging a plurality of liquid streams from discharge means 37 and, in this case, through liquid flow tubes 38 and 38', at low discharge velocity. At the same time, continuous air curtain is discharged from air slit 50, and is directed toward the discharging liquid streams emanating from discharge means 37. The air and liquid, respectively, intersect at the minimum contact angle described above. When the continuous, high velocity air curtain contacts the low velocity liquid streams 15, a high velocity, continuous, uniform liquid spray curtain 16 (not shown) is formed, without impeding the liquid flow, but, contrarily, the liquid velocity, after the liquid exits from the orifices, is substantially increased, causing atomization of the liquid. Curtain 16 exhibits a high boundary layer penetration level over a controled, extensive particle size range without causing substantial streaking when sprayed onto a moving surface, and without exhibiting interfacing problems between the respective spray streams.

When, as described in the preceding discussion, an aqueous solution of a processing liquid, such as a creping adhesive, and the like, is employed, the total amount of liquid 15 being discharged from liquid discharge means 37 can be substantially lower than for the same liquid, at the same total solids level, employing, for example, a hydraulic nozzle system. The use of a lower amount of liquid results to a large extent from the use of a larger number of individual discharge means 37, preferably including liquid flow tubes 38 and 38', having a relatively large total cross-sectional flow area per longitudinal foot, of said header means 21 and 21', i.e., $A_x$, and a lower solution velocity. Thus, if a 1% solution is employed, for example, the preferred $A_x$ of the discharge orifice 37' is from about 0.01 square inch per foot to about 0.09 square inch per foot, and more preferably from about 0.02 square inch per foot to about 0.06 square inch per foot.

At the same time, a high velocity air stream is supplied from air supply header 41. The velocity of the air exiting from the air slit 50 must be significantly higher than the velocity of the liquid 15 exiting from discharge means 37. The magnitude of this difference has been previously described. A critical feature of this invention is the minimum contact angle $\beta$ at which a continuous, high velocity air curtain is directed with respect to the liquid 15 being discharged at low velocity from discharge means 37. Instead of impeding the flow of the discharging liquid, the method of the present invention provides that a continuous air curtain contacts the liquid at an angle which will impel the liquid at a high velocity and will form a continuous, uniform liquid spray curtain having a relatively high boundary layer penetration level over a controled, extensive particle-size range. The minimum contact angle is preferably controled, as in FIG. 2, by air flow guide means 48 disposed in a plane substantially parallel to the center line 37*a* of discharge means 37. The air flow guide means in conjunction with movable sidewall means 42*a*, respectively, cause the air to be discharged so as to produce the requisite minimum contact angles previously described.

A continuous, uniform, low velocity liquid stream is emitted from discharge means 37 due, to the most part, to the maintenance of a positive static pressure head on said discharge means. The static head on discharge means 37 is, in turn, maintained by the positive static pressure within liquid reservoir 33. More specifically, by employing a liquid reservoir which extends below the entire extent of the inlet portions of discharge means 37, the reservoir 33 is substantially filled with liquid under pressure, and all of the discharge means 37 will, in turn, be filled with liquid under pressure, which will result in the uniform, continuous discharge of said liquid from said discharge means. As previously described, the positive pressure which is maintained in the liquid reservoir 33 is a direct consequence of labyrinths 26 and 26' which internally meter the liquid flow and facilitate the liquid communication from liquid reservoir 33 to discharge means 37.

Longitudinal extent of the liquid spray curtain can be adjusted, depending on the width of the moving surface to be sprayed, by providing, such as by inserting within discharge means 37, or by substituting for liquid flow tubes 38 and 38' which are hollow in construction, means for plugging said liquid streams, at points beyond the width of the moving surface, so that the liquid 15 cannot pass therethrough.

The moisture profile of a moving surface having a lower moisture content at its edges than at its central portion can be adjusted employing the system of this invention. Specifically, a means can be provided for measuring the moisture profile of the moving surface at a point prior to the subject linear nozzle system. By increasing the liquid flow to the outermost points in the subject system, i.e., to the outermost points in the liquid header, the liquid flow rate to the innermost points in the respective headers is reduced, thereby producing a liquid spray curtain having a moisture profile in which the outer edges of the moving surface are moisturized to a much greater extent than the central portion thereof, and a moisture profile results.

The spray liquid 15 can comprise any liquid material which can be effectively discharged from discharge means 37 without causing substantial plugging thereof. The magnitude of the liquid materials which can be employed is far more substantial than those liquids which can be sprayed from hydraulic and sonic systems. The method of the present invention requires only a low exit velocity and the area of liquid flow is substantially greater than in the previously described prior art systems. Typically, various aqueous liquid solutions are employed as the liquid 15. Water, itself, can also be sprayed on a moving surface in order to moisturize the same, as described above.

In a preferred method of this invention, a liquid adhesive solution can be sprayed on a cellulosic papermaking web, and after being sprayed with the subject liquid spray curtain, the web can be adhered to a thermal drying cylinder and then uniformly creped to produce a softer, bulkier cellulosic web product. Furthermore, this same liquid spray curtain can also be sprayed directly onto a moving surface crossing the thermal drying cylinder per se. Typical creping adhesives include various natural and synthetic materials which are well-known in the papermaking art. Exemplary materials include carboxymethyl cellulose, polyvinyl alcohol, animal glue, and the like.

I claim:

1. A system for producing a liquid spray curtain capable of uniformly covering the entirety of a moving surface to be sprayed, without substantial streaking thereof, comprising:

(a) a liquid supply means comprising at least one liquid supply header for discharging a plurality of liquid streams at low velocity;

(b) air supply means comprising an air supply header including means for discharging a continuous, high velocity air curtain for contacting said liquid streams to produce said liquid spray curtain; and (c) air flow guide means located at the outermost end of said air supply header and disposed parallel to the center line of said liquid discharge means.

2. The system of claim 1, wherein said air supply header comprises first and second sidewall members, respectively, said second sidewall member adapted for movement to a plurality of positions with respect to said first sidewall member, and said air flow guide means located at the outermost end of said first sidewall member.

3. The system of claim 1, wherein said air supply header having formed therewithin an air supply chamber which converges at its outermost end to form a continuous exit air slit through which said air curtain exits, and said air supply means includes air flow adjustment means for adjusting the quantity of air being emitted from said air slit.

4. The system of claim 1, wherein said air supply means includes means for adjusting the position of said second sidewall member with respect to said air flow guide means such that a high velocity, continuous air curtain is discharged from said exit slit and will contact said liquid streams at a minimum contact angle measured from the center line of said liquid discharge means.

5. The system of claim 4, wherein said minimum contact angle is between about −10° and +30°.

6. The system of claim 1, wherein said discharge means has disposed therewithin liquid flow tubes further controling the discharge of liquid.

7. The system of claim 6, wherein a pair of liquid supply headers is provided, and said liquid flow tubes are in individual or alternate communication with the liquid in the liquid supply headers so that the system will continue to operate even if one of said headers requires maintenance.

8. The system of claim 1, wherein said liquid supply means comprises liquid supply headers, said liquid supply headers being disposed at right angles, one with respect to the other.

9. A system for producing a liquid spray curtain capable of uniformly covering the entirety of a moving surface to be sprayed, without substantial streaking thereof, comprising:

(a) liquid supply means for discharging a plurality of liquid streams at low velocity;

(b) air supply means for discharging a continuous, high velocity air curtain for contacting said liquid streams to produce said liquid spray curtain, said air supply means including an air flow guide means located at the outermost end of said air supply means and disposed parallel to the center line of said liquid discharge means, an exit air slot, means for adjusting the magnitude of said exit air slit, and means for adjusting the magnitude of the minimum air contact angle, the angle at which the air curtain contacts said liquid streams measured from the center line of said liquid discharge means, to between about −10° and +30°.

10. A system for producing a liquid spray curtain capable of uniformly covering the entirety of a moving surface to be sprayed, without substantial streaking thereof, comprising:

(a) means for discharging a plurality of liquid streams at low velocities;

(b) air supply means for discharging a continuous, high velocity air curtain for contacting said liquid streams to produce said liquid spray curtain, said air supply means including an air flow guide means disposed parallel to the center line of said liquid discharge means and located at the outermost end of said air supply means, an exit air slit, means for adjusting the magnitude of said exit air slit, and means for adjusting the magnitude of the minimum air contact angle, the angle at which the air curtain contacts said liquid streams, measured from the center line of said liquid discharge means.

11. The system of claim 10, wherein said minimum contact angle is between about −10° and +30°.

12. A system for producing a liquid spray curtain capable of uniformly covering the entirety of a moving surface to be sprayed, without substantial streaking thereof, comprising:

(a) a liquid supply means comprising liquid supply headers, disposed at right angles, one with respect to the other, for discharging a plurality of liquid streams at low velocity;

(b) air supply means comprising an air supply header including means for discharging a continuous, high velocity air curtain for contacting said liquid streams to produce said liquid spray curtain, said air supply header comprising first and second sidewall members, respectively, said second sidewall member adapted for movement to a plurality of positions with respect to said first sidewall member, said air supply header having formed therewithin an air supply chamber which converges at its outermost end to form a continuous exit air slit through which said air curtain exits;

(c) air flow guide means located at the outermost end of said first sidewall member and disposed parallel to the center line of said liquid discharge means;

(d) air flow adjustment means for adjusting the quantity of air being admitted from said air slit; and (e) means for adjusting the position of said second sidewall member with respect to said air flow guide means such that a high velocity, continuous air curtain is discharged from said exit slit which will contact said liquid streams at a minimum contact angle, measured from the center line of said liquid discharge means, of between about −10° and +30°.

13. A system for producing a liquid spray curtain capable of uniformly covering the entirety of a moving surface to be sprayed, without substantial streaking thereof, comprising:

(a) a liquid supply means comprising at least one liquid supply header for discharging a plurality of liquid streams at low velocity;

(b) air supply means comprising an air supply header including means for discharging a continuous, high velocity air curtain for contacting said liquid streams to produce said liquid spray curtain, said air supply header comprising first and second sidewall members, respectively, said second sidewall member adapted for movement to a plurality of positions with respect to said first sidewall member, said air supply header having formed therewithin an air supply chamber which converges at its outermost end to form a continuous exit air slit through which said air curtain exits;

(c) air flow guide means located at the outermost end of said first sidewall member, said air flow guide means being disposed parallel to the center line of said liquid discharge means;

(d) air flow adjustment means for adjusting the quantity of air being admitted from said air slit; and (e) means for adjusting the position of said second sidewall member with respect to said air flow guide means such that a high velocity, continuous air curtain is discharged from said exit slit which will contact said liquid streams at a minimum contact angle, measured from the center line of said liquid discharge means, of between about −10° and +30°.

14. The system of claim 13, wherein said discharge means has disposed therewithin liquid flow tubes further controling the discharge of liquid.

15. The system of claim 14, wherein a pair of liquid supply headers is provided, and said liquid flow tubes are in individual and alternative communication with the liquid in the liquid supply headers so that the system will continue to operate even if one of said headers requires maintenance.

16. The system of claim 13, wherein said liquid supply headers are disposed at right angles, one with respect to the other.

17. A system for producing a liquid spray curtain capable of uniformly covering the entirety of a moving surface to be sprayed, without substantial streaking thereof, comprising:

(a) liquid supply means comprising liquid supply headers for discharging a plurality of liquid streams at low velocity, said liquid supply headers being disposed at right angles, one with respect to the other; and (b) air supply means comprising an air supply header including means for discharging a continuous, high velocity air curtain for contacting said liquid streams to produce said liquid spray curtain.

18. The system of claim 17, wherein said high velocity air curtain contacts said liquid streams at a minimum contact angle, measured from the center line of said liquid discharge means, of from about −10°, up to about +30°.

19. A system for producing a liquid spray curtain capable of uniformly covering the entirety of a moving surface to be sprayed, without substantial streaking thereof, comprising:

(a) a liquid supply means comprising liquid supply headers, disposed at right angles one with respect to the other, for discharging a plurality of liquid streams at low velocity, each of said liquid supply headers comprising:

(i) a liquid supply chamber, (ii) labyrinth means located within said liquid supply chamber for internally metering and longitudinally distributing the liquid flow, (iii) liquid reservoir means extending across essentially the entire longitudinal distance of said header, and (iv) means for discharging said liquid streams at a continuous, uniform flow rate which are adapted for liquid communication with the liquid reservoir means so that when said reservoir means is filled with liquid, said continuous, uniform flow rate is maintained by a constant, static pressure head in said reservoir means; and (b) air supply means comprising an air supply header which includes means for discharging a continuous, high velocity air curtain for contacting said liquid streams to produce said liquid spray curtain, said air supply header comprising a first sidewall member, a pair of end wall members, and a floor member, respectively, joined one to the other, and a second sidewall member adapted for movement to a plurality of positions with respect to said first sidewall member, said air supply header having formed therewithin an air supply chamber which converges at its outermost end to form a continuous exit air slit through which said air curtain exits, said first sidewall member having an air flow guide means located at its outermost end which is disposed with respect to the center line of said liquid discharge means such that when said second sidewall member is positioned with respect to said air guide means, a high velocity, continuous air curtain is discharged from said exit slit which will contact said liquid streams at a minimum contact angle, measured from said center line, of between about −10° and +30°.

20. A system for producing a liquid spray curtain capable of uniformly covering the entirety of a moving surface to be sprayed, without substantial streaking thereof, comprising (a) a liquid supply means comprising at least one liquid supply header for discharging a plurality of liquid streams at low velocity, said liquid supply header comprising (i) a liquid supply chamber, (ii) labyrinth means located within said liquid supply chamber for internally metering and longitudinally distributing the liquid flow, (iii) liquid reservoir means extending across essentially the entire longitudinal distance of said header, and (iv) means for discharging said liquid streams at a continuous, uniform flow rate which are adapted for liquid communication with the liquid reservoir means so that when said reservoir means is filled with liquid, said continuous, uniform flow rate is maintained by a constant, static pressure head in said reservoir means; and (b) air supply means comprising an air supply header which includes means for discharging a continuous, high velocity air curtain for contacting said liquid streams to produce said liquid spray curtain, said air supply header comprising a first sidewall member, a pair of end wall members, and a floor member, respectively, joined one to the other, and a second sidewall member adapted for movement to a plurality of positions with respect to said first sidewall member, said air supply header having formed therewithin an air supply chamber which converges at its outermost end to form a continuous exit air slit through which said air curtain exits, said first sidewall member having an air flow guide means located at its outermost end which is disposed parallel with respect to the center line of said liquid discharge means such that when said second sidewall member is positioned with respect to said air guide means, a high velocity, continuous air curtain is discharged from said exit slit which will contact said liquid streams at a minimum contact angle, measured from said center line, of between about −10° and +30°.

21. The system of claim 20, wherein the cross-sectional flow area of said discharge means per longitudinal foot of said liquid supply header is from about 0.01 to about 0.09 square inch per longitudinal foot.

22. The system of claim 20, wherein sad discharge means has disposed therewithin liquid flow tubes for further controling the discharge of liquid.

23. The system of claim 22, wherein a pair of liquid supply headers is provided, and said liquid flow tubes are in individual and alternative communication with the liquid in the liquid supply headers so that the system will continue to operate even if one of said headers requires maintenance.

24. The system of claim 20, wherein the longitudinal extent of the liquid spray curtain is adjusted, depending on the width of the moving surface to be sprayed, by providing means for plugging said liquid streams, so that the liquid cannot pass therethrough, at points beyond the width of said moving surface.

25. The system of claim 20, wherein a liquid spray curtain is provided, capable of moisturizing the outer edges of the moving surface to a much higher extent than the central portion thereof by maintaining the liquid flow rate to the outermost points of said liquid header at a higher rate than the rate to the innermost points of said liquid header.

* * * * *